US006929502B2

(12) United States Patent
Miwa

(10) Patent No.: US 6,929,502 B2
(45) Date of Patent: Aug. 16, 2005

(54) LAMP SOCKET AND SOCKET ASSEMBLY

(75) Inventor: Takeya Miwa, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/042,321

(22) Filed: Jan. 11, 2002

(65) Prior Publication Data

US 2002/0094716 A1 Jul. 18, 2002

(30) Foreign Application Priority Data

Jan. 12, 2001 (JP) ..... P2001-005386

(51) Int. Cl.[7] ..... H01R 4/24
(52) U.S. Cl. ..... 439/419; 439/907; 362/227
(58) Field of Search ..... 439/419, 404, 439/414, 907, 36, 699.2; 362/226, 227, 249, 252

(56) References Cited

U.S. PATENT DOCUMENTS 3,716,819 A 2/1973 Borth
4,264,117 A * 4/1981 Pritulsky ..... 439/419
5,639,246 A 6/1997 Holmes
5,931,691 A * 8/1999 Mews et al. ..... 439/419
6,086,408 A * 7/2000 Tanigawa ..... 439/419
6,343,942 B1 * 2/2002 Okamoto ..... 439/419
6,494,723 B2 * 12/2002 Yamane et al. ..... 439/907

FOREIGN PATENT DOCUMENTS

EP 0 080 683 A1 11/1982
EP 0 999 617 A1 5/2000
JP 8-138811 5/1996

OTHER PUBLICATIONS

Patent Abstract of Japan 08–138811, May 31, 1996.

* cited by examiner

*Primary Examiner*—Tho D. Ta
*Assistant Examiner*—Felix O. Figueroa
(74) *Attorney, Agent, or Firm*—Sughrue Mion, PLLC

(57) ABSTRACT

A lamp socket (20) of the invention mainly includes an upper socket (21), a lower socket (22), and terminal members (23). The upper socket 21 has a bulb mounting portion (25) formed on an upper side of an socket body (24), and a wire connection portion (26) is formed on a side surface of the socket body (24). This wire connection portion (26) has two wire insertion grooves (30, 30) formed by opposite side walls (27, 27), projecting from the socket body (24), and a partition wall (28). The lower socket (22) has a connector housing (35) formed on a lower side of a lower socket body (34), and a terminal receiving plate (36) projects from a side surface of the lower socket body. Terminal setting grooves (37) are formed in this terminal receiving plate (36).

20 Claims, 6 Drawing Sheets

LAMP SOCKET AND SOCKET ASSEMBLY

BACKGROUND OF THE INVENTION

This invention relates generally to a lamp socket and a socket assembly used in an automotive lamp, and more particularly to a lamp socket, to which wires can be directly connected, and also to a socket assembly employing these lamp sockets.

FIG. 7 shows one example of related lamp socket used in an automotive lamp. This lamp socket 1 includes a bulb mounting portion 1*a*, in which a bulb 3 can be mounted, a flange portion 1*b*, and a connector housing 1*c* for fitting on a power supply connector 13. Terminal members 2 for electrical connection to the bulb 3 project into the interior of the connector housing 1*c*.

As a preliminary step before the mounting of the lamp socket 1, wires 7 are installed on a lamp unit body 5 as shown in FIG. 9. More specifically, the wires 7 are received respectively in connection portions 4 disposed adjacent to a socket mounting hole 6, as shown in FIG. 7, and a press-connecting terminal 8, having press-connecting blades 9, is inserted into this connection portion from the upper side, so that the press-connecting blades 9 cut a sheath 10 of the wire 7, and come into contact with a conductor 11 thereof, as shown in FIG. 8.

Then, the lamp socket 1 is mounted in the socket mounting hole 6, so that the terminal members 2 of the lamp socket 1 are contacted with the press-connecting terminals 8, respectively, and therefore are electrically connected to the wires 7, respectively. When the bulb 3 is attached to the bulb mounting portion 1*a* of the lamp socket 1, the terminal members 2 are electrically connected to the bulb 3. In this manner, the plurality of lamp sockets 1 are arranged on the lamp unit body 5, and are connected together through the wires 7 to form a lamp unit.

However, since the above related lamp socket 1 does not have any connection portion for the wires, the wires 7 must be installed on the lamp unit body 5. Therefore, each time the configuration of the lamp unit body 5 is changed, the arrangement of the lamp sockets 1, the installation of the wires and so on need to be changed, and therefore there was encountered a problem that the assembling operation was complicated, so that the cost increased.

And besides, since the lamp sockets 1 are attached afterwards, there are occasions when the lamp socket 1 is mounted in a wrong position (In this case, the circuit is not established). In order to prevent such wrong attachment, wrong attachment prevention ribs 12 of different shapes are provided on the respective lamp sockets as shown in FIG. 10 so that the lamp sockets 1A, 1B and 1C can be distinguished in appearance from one another. Their shapes are thus different from one another, and therefore there was encountered a problem that the number of molds increased, so that the cost increased.

SUMMARY OF THE INVENTION

This invention has been made in order to solve the above problems, and an object of the invention is to provide a lamp socket and a lamp socket assembly, in which the lamp socket is so constructed that wires can be connected directly thereto, thus eliminating the need for installing the wires on a lamp unit body, and there is achieved such a general-purpose ability as to meet a wide variety of lamp arrangements.

In order to solve the aforesaid object, the invention is characterized by having the following arrangement.

(1) A lamp socket in which a plurality of the lamp sockets are mounted on a lamp unit body and are connected together through wires, the lamp socket comprising:

a socket body;

a connector housing for accommodating a connector provided to the socket body;

a bulb mounting portion for mounting a lamp provided to the socket body; and a terminal member provided within the socket body so that the wire, the connector and the lamp can be electrically directly connected thereto.

(2) The lamp socket according to (1), wherein the socket body is provided with a wire connection portion for an electrical connection of the terminal member to the wire.

(3) The lamp socket according to (2), wherein the wire connection portion includes a wire insertion grooves in which the terminal member is mounted; and the terminal member includes at one end a press-connecting blade which can bite into a sheath of the wire to electrically connect to a conductor of the wire, at the other end a male tab projecting into an interior of the connector housing for electrically connecting to the connector.

(4) The lamp socket according to (3), wherein the bulb is brought in contact with a portion of the terminal member between the press-connecting blade and the male tab.

(5) The lamp socket according to (3), wherein the wire insertion groove is provided with opposed retaining projections at an end of an opening thereof, and distance between the opposed retaining projections is smaller than an outer diameter of the wire.

(6) A socket assembly comprising:

a lamp unit body; and a plurality of lamp sockets mounted on the lamp unit body and are connected together through wires, each of the plurality of lamp sockets including, a socket body a connector housing for accommodating a connector provided to the socket body, a bulb mounting portion for mounting a lamp provided to the socket body, and a terminal member provided within the socket body so that the wire, the connector and the lamp can be electrically directly connected thereto, wherein the plurality of lamp sockets are electrically connected together through the wires connected to the terminal members.

(7) The socket assembly according to (6), wherein the plurality of lamp sockets are connected to one another by the wires of different lengths.

(8) The socket assembly according to (6), wherein the socket body is provided with a wire connection portion for an electrical connection of the terminal member to the wire.

(9) The socket assembly according to (8), wherein the wire connection portion includes a wire insertion grooves in which the terminal member is mounted; and the terminal member includes at one end a press-connecting blade which can bite into a sheath of the wire to electrically connect to a conductor of the wire, at the other end a male tab projecting into an interior of the connector housing for electrically connecting to the connector.

(10) The socket assembly according to (9), wherein the bulb is brought in contact with a portion of the terminal member between the press-connecting blade and the male tab.

(11) The socket assembly according to (9), wherein the wire insertion groove is provided with opposed retaining projections at an and of an opening thereof, and distance between the opposed retaining projections is smaller than an outer diameter of the wire.

In the lamp socket of the above construction, the plurality of lamp sockets can be beforehand connected together through the wire connection portions by the plurality of wires cut into a plurality of lengths. Therefore, this assembly can be used in a region, having a different lamp arrangement, if the wires have the corresponding lengths, and therefore it can be used for various kinds of lamp units.

In the lamp socket of the above construction, the wire connecting operation can be effected in a one-touch manner by press-fitting each wire into the wire insertion groove.

In the lamp socket of the above construction, the wire, mounted in the wire insertion groove, is retained by the retaining projections, and is prevented from withdrawal.

In the socket assembly of the above construction, the plurality of lamp sockets are beforehand connected together by the wires to form the socket assembly, and by doing so, this assembly can be used for various kinds of lamp unit bodies having different lamp arrangements, and the wire installing operation does not need to be effected at the lamp unit body, and therefore the production cost can be reduced.

In the socket assembly of the above construction, a wrong attachment can be prevented by the different wire lengths.

DETAILED DESCRIPTION OF PREFERRED EMBODIMENTS

Figure 1:
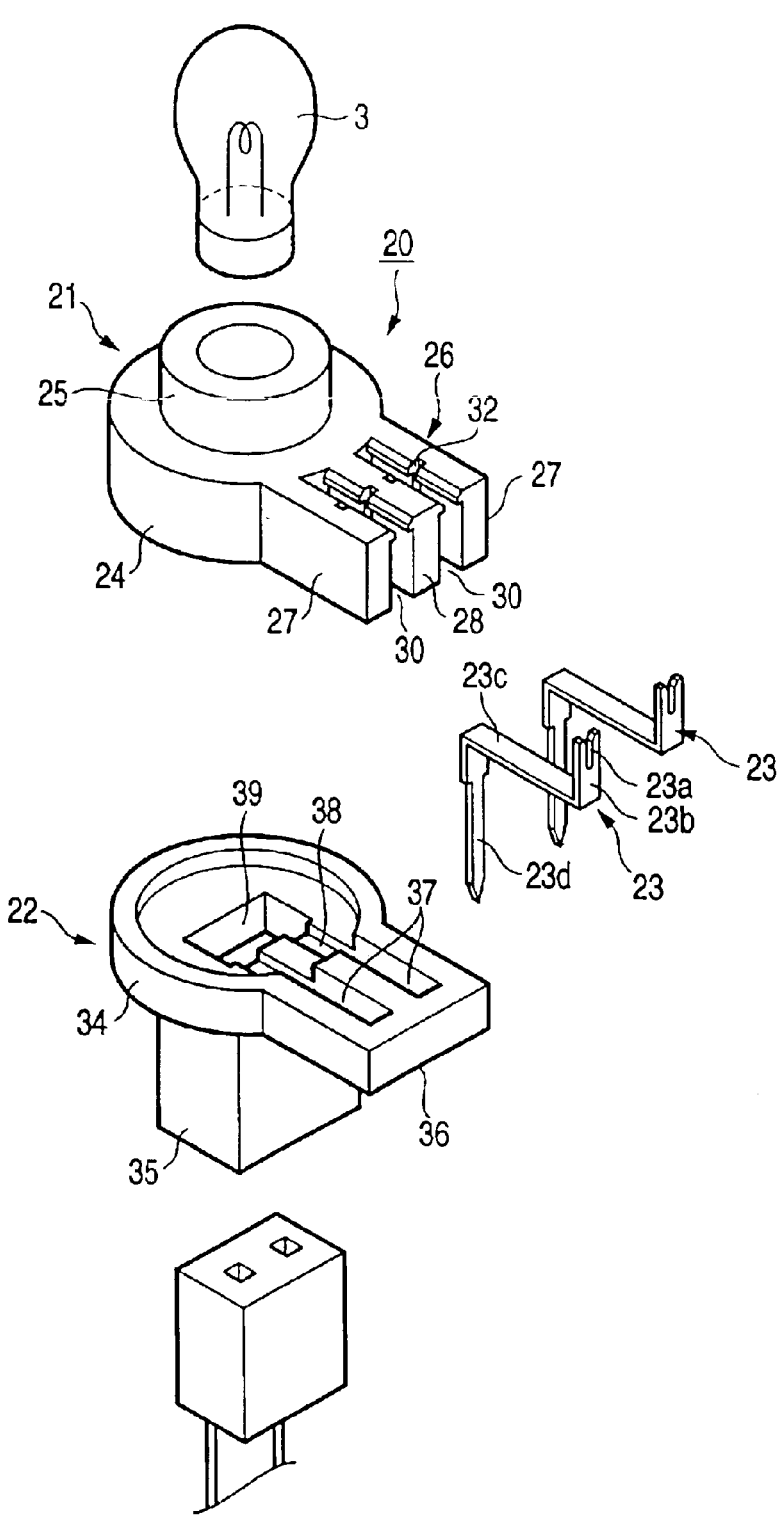
FIG. 1 is an exploded, perspective view showing one preferred embodiment of a lamp socket of the present invention.

A lamp socket and a socket assembly, provided according to one preferred embodiment of the present invention, will now be described with reference to FIGS. 1 to 6. Those members, identical in construction or function to those of the prior art structure, will be designated by identical reference numerals, respectively, and detailed description thereof will be omitted.

Figure 2:
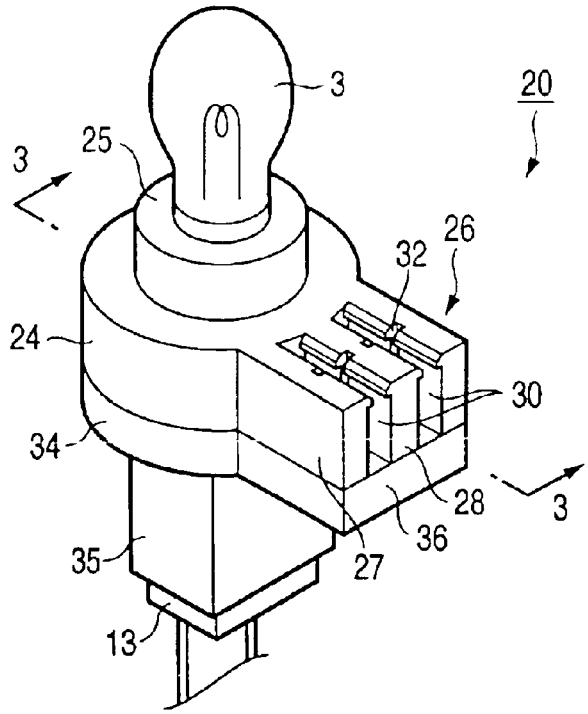
FIG. 2 is a perspective view of the lamp socket of FIG.
Figure 3:
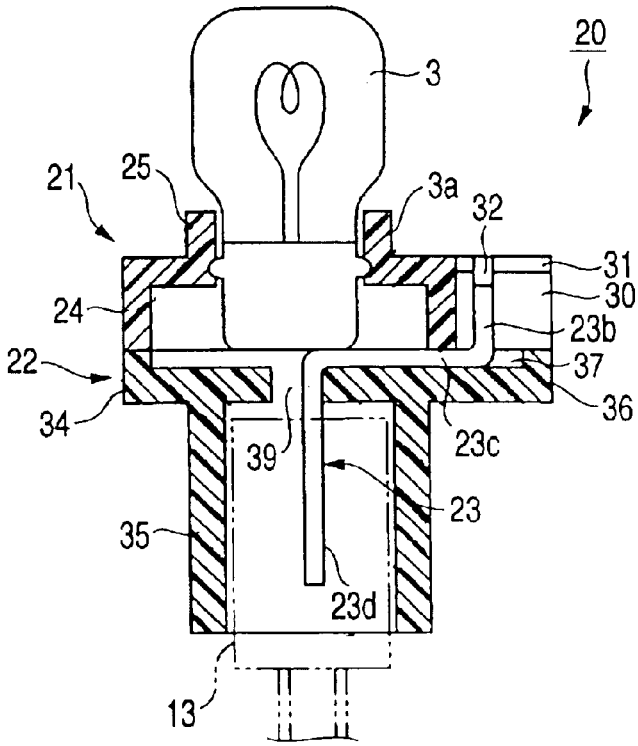
FIG. 3 is a cross-sectional view taken along the line 3—3 of FIG. 2.
Figure 4:
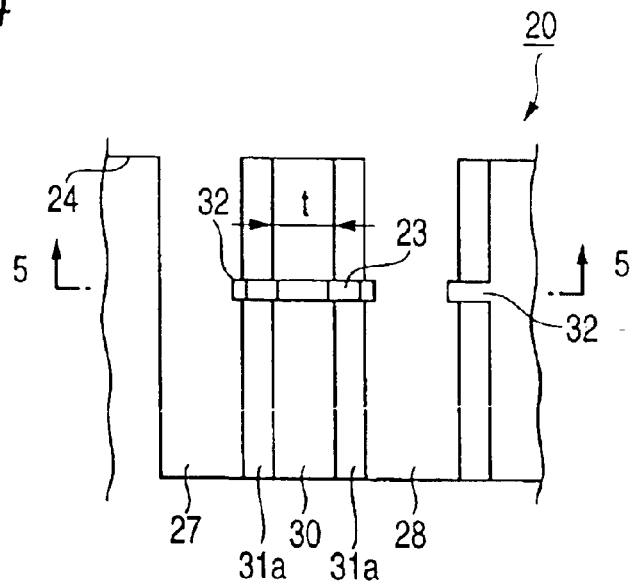
FIG. 4 is a plan view of a wire connection portion of FIG. 2.
Figure 5:
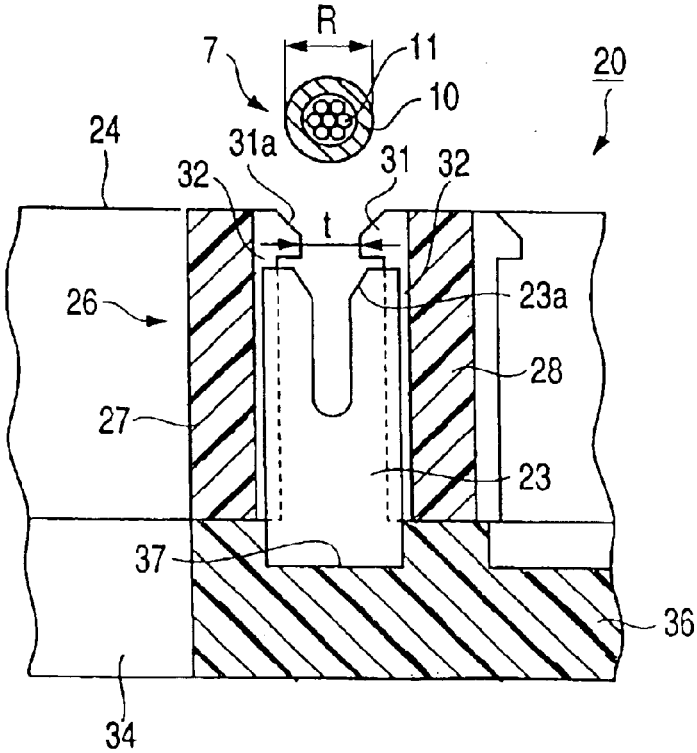
FIG. 5 is a cross-sectional view taken along the line 5—5 of FIG. 4.
Figure 6:
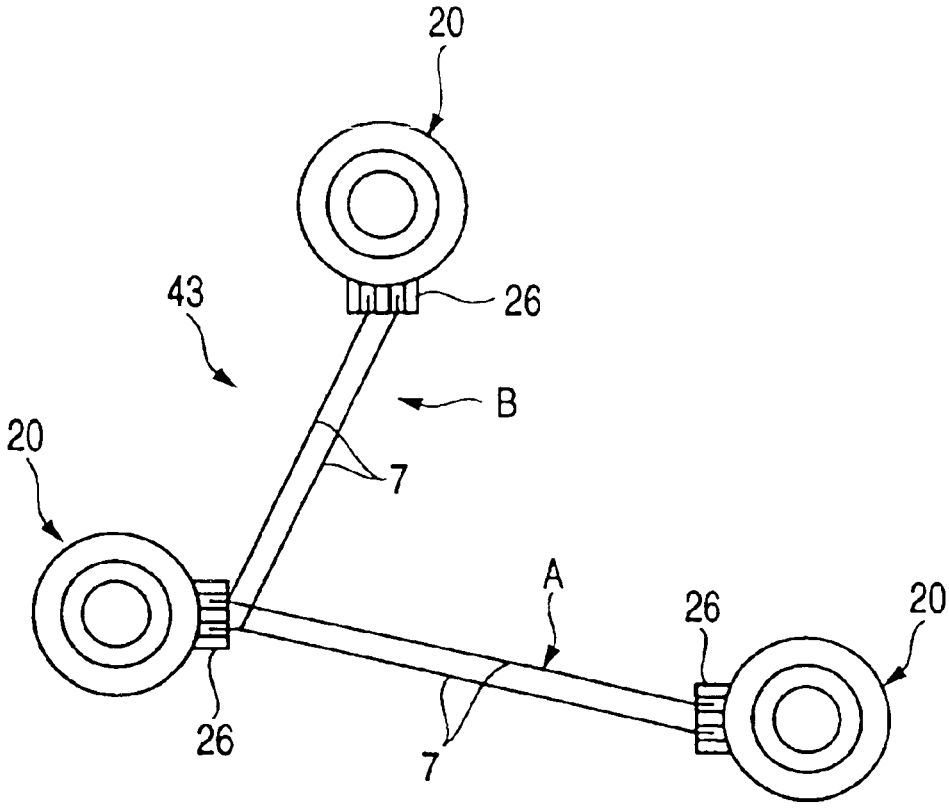
FIG. 6 is a plan view showing One preferred embodiment of a socket assembly of the invention.
Figure 7:
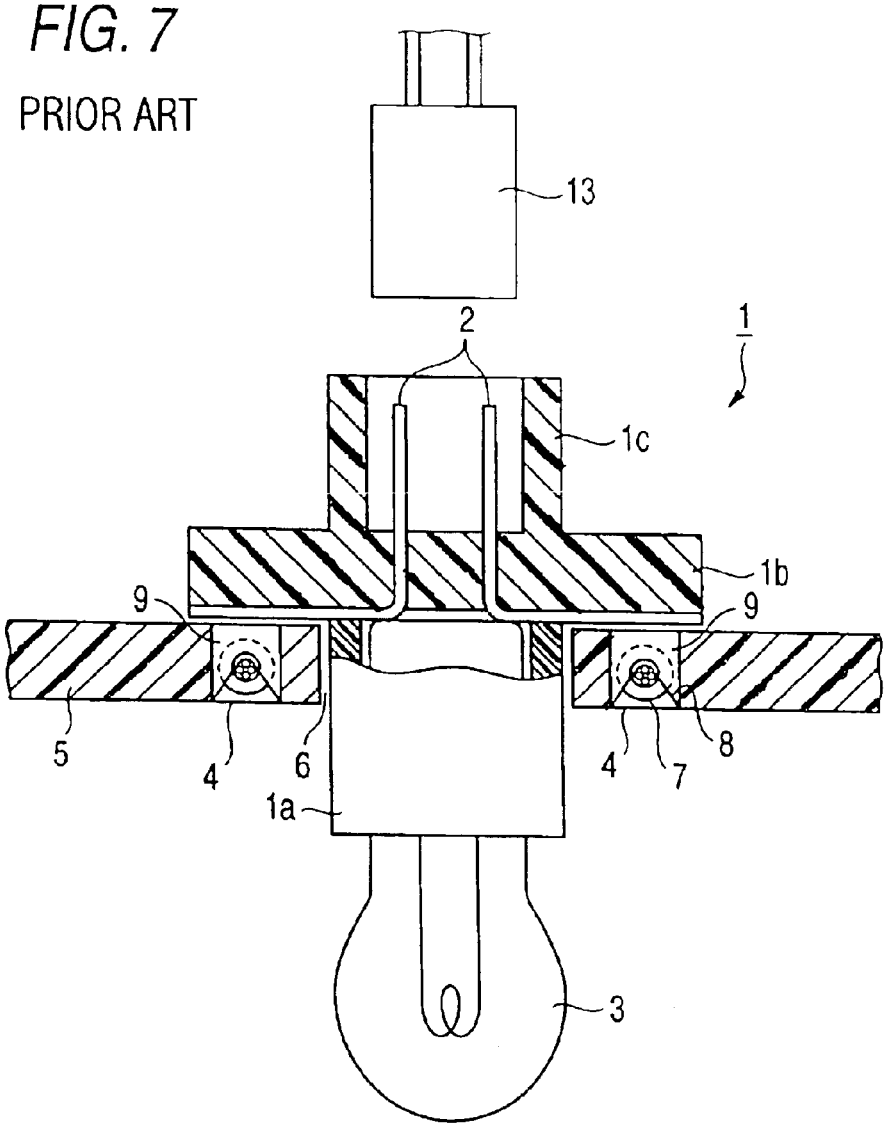
FIG. 7 PRIOR ART
FIG. 7 is a vertical cross-sectional, side-elevational view of a related lamp socket.
Figure 8:
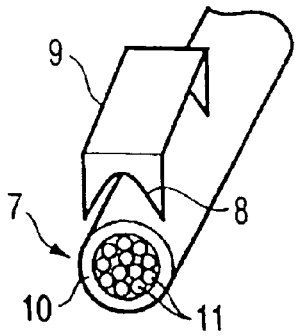
FIG. 8 PRIOR ART
FIG. 8 is a perspective view showing related press-connecting blades for wire connecting purposes.
Figure 9:
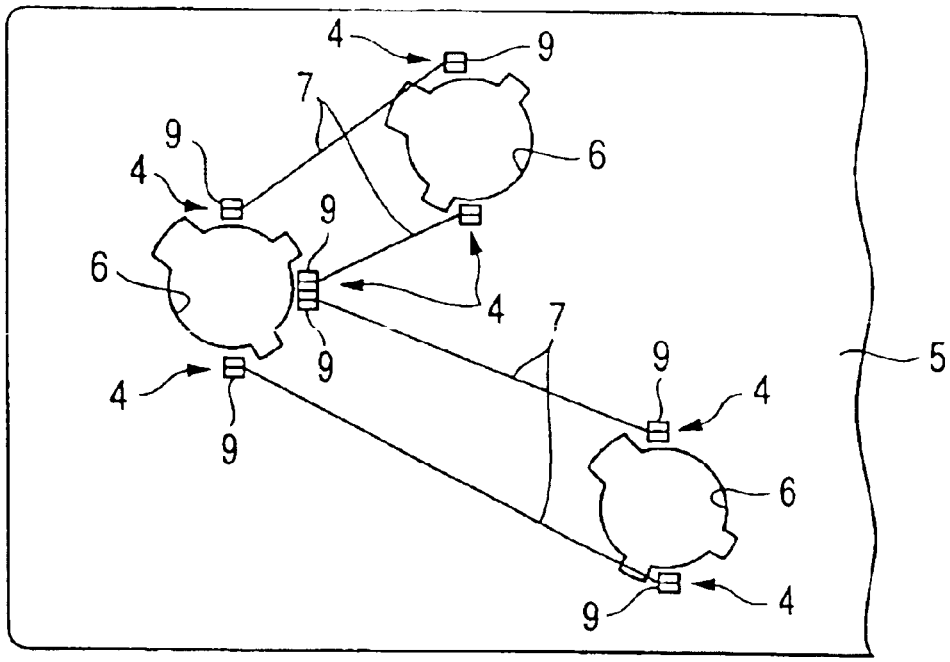
FIG. 9 PRIOR ART
FIG. 9 is a plan view showing the arrangement of the related lamp sockets.
Figure 10A:
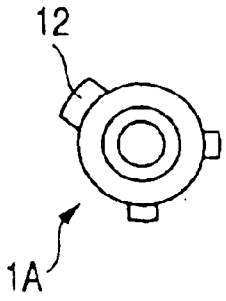
FIG. 10A PRIOR ART
FIGS. 10A. 10B, and 10C are plan views showing related lamp sockets having wrong attachment prevention ribs.
Figure 10B:
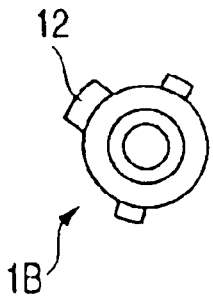
FIG. 10B PRIOR ART
Figure 10C:
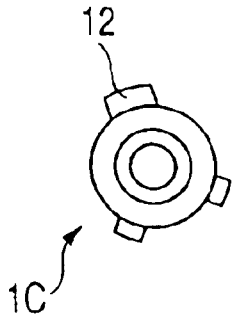
FIG. 10C PRIOR ART

FIG. 1 is an exploded, perspective view showing one preferred embodiment of the lamp socket of the invention, FIG. 1 is a perspective view of the lamp socket of FIG. 1, FIG. 3 is a cross-sectional view taken along the line 3—3 of FIG. 2, FIG. 4 is a plan view of a wire connection portion of FIG. 2, FIG. 5 is a cross-sectional view taken along the line 5—5 of FIG. 4, and FIG. 6 is a plan view showing one preferred embodiment of the socket assembly of the invention.

As shown in FIGS. 1 and 2, the lamp socket 20 according to the invention mainly comprises an upper socket 21, a lower socket 22, and terminal members 23. In the upper socket 21, a bulb mounting portion 25 is formed on an upper side of a cylindrical socket body 24, and the wire connection portion 26 is formed on a side surface of the socket body 24. This wire connection portion 26 has two wire insertion grooves 30 and 30 formed by opposite side walls 27 and 27, projecting from the socket body 24, and a partition wall 28.

As shown in FIG. 5, opposed retaining projections 31, having tapering surfaces 31*a*, respectively, project respectively front upper ends of each side wall 27 and the partition wall 28 to partially close the wire insertion groove 30. A dimension t between these retaining projections 31 and 31 is smaller than an outer diameter R of a wire 7. Terminal insertion grooves 32 are formed respectively in inner surfaces of each side wall 27 and the partition wall 28, and are formed in the retaining projections 31 (see FIG. 4).

As shown in FIGS. 1 and 2, in the lower socket 22, a connector housing 35 for accommodating a power supply connector 13 is formed on a lower side of a disk-like lower socket body 34, and a terminal receiving plate 36 projects from a side surface of this lower socket body. Terminal setting grooves 37, which are to be disposed in registry with the wire insertion grooves 30, respectively, are formed in the terminal receiving plate 36. A through hole 39, communicating with the interior of the connector housing 35, is formed through a bottom portion of the lower socket body 34, and the terminal setting grooves 37 are formed to extend continuously to this through hole 39 (see FIG. 3).

As shown in FIGS. 1 and 5, in the terminal member 23, a male tab 23*d*, directed downwardly in the drawings, is formed integrally with a wire press-connecting portion 23*b* (having a press-connecting blade 23*a* at one end thereof) through an intermediate bent portion 23*c*. Each terminal member 23 is mounted in the wire insertion groove 30 in the upper socket 21 and the terminal setting groove 37 in the lower socket 22.

Namely, the wire press-connecting portion 23*b* of each terminal member is inserted into the corresponding terminal insertion groove 32 from the lower side of the upper socket 21, and then the upper socket 21 is attached to the lower socket 22, and by doing so, the lamp socket 20 is assembled as shown in FIG. 2. In this lamp socket 20, the wire connection portion 26 and the terminal receiving plate 36 project respectively from the side surfaces of the upper and lower socket bodies 24 and 34.

As shown in FIG. 3, the bent portions 23*c* of the terminal members 23 are set in the terminal setting grooves 37, respectively, and the male tabs 23*d* project into the interior of the connector housing 35 through the through hole 39. Then, when a bulb 3 is attached to the bulb mounting portion 25 of the upper socket 21, a connection portion 3*a* of the bulb 3 is contacted with the terminal members 23 and 23 to be electrically connected thereto. When the power supply connector 13 is accommodated in the connector housing 35, the power supply connector 13 is electrically connected to the male tabs 23*d* of the terminal member 23.

When the wire 7 is press-fitted into the wire insertion groove 30 from the upper side as shown in FIG. 5, the press-connecting blade 23*a* of the terminal member 23 bites into a sheath 10, and comes into contact with a conductor 11, and therefore is electrically connected to the terminal member 23. The wire 7 is forced through the gap between the opposed retaining projections 31, and is disposed on the lower sides of these retaining projections, and therefore is prevented from withdrawal.

As described above, in the socket assembly 43 of this embodiment, the wire connection portion 26 is provided at each lamp socket 20, and therefore the lamp sockets 20 can be beforehand connected together by the wires.

For example, three (this number is arbitrary) lamp sockets 20 are beforehand connected together by the wires 7 as shown in FIG. 6, and by doing so, this assembly can be used in a region, having a different lamp arrangement, if the wires 7 have the corresponding lengths, and therefore it can be used for various kinds of lamp units. The length of the wires 7 at an installation side A is made different from the length of the wires 7 at an installation side B (A>B) so that those regions to be connected together by the wires of the longer installation side A can be not connected together by the wires of the shorter installation side B. By dosing so, a wrong attachment can be prevented.

The present invention is not limited to the above embodiment, and other embodiments of the invention can be provided. For example, although the wire connection portion 26 has such a construction that the terminal members 23, each having the press-connecting blade 23*a*, are mounted respectively in the wire insertion grooves 30, the invention is not limited to this construction, and for example there can be used a construction in which a terminal member 23 is compressively pressed to be connected to the wire 7.

As described above in detail, in the lamp socket of the present invention, the wire connection portion for electrical connection to the terminal members within the connector housing is formed integrally with the lamp socket.

Therefore, the plurality of lamp sockets can be beforehand connected together through the wire connection portions by the wires, and this assembly can be used in a region, having a different lamp arrangement. Therefore, the wire installing operation does not need to be effected at the lamp unit body, and therefore the production cost can be reduced, and besides the excellent general-purpose ability is achieved, and a wrong attachment can be eliminated.

In the lamp socket, the wire connection portion includes the wire insertion grooves, and has the terminal members mounted respectively in the wire insertion grooves, and the terminal member has at one end the press-connecting blade which can bite into the sheath of the wire to contact the conductor of the wire, and also has at the other end the male tab projecting into the interior of the connector housing.

Therefore, the wire connecting operation can be effected in a one-touch manner by press-fitting each wire into the wire insertion groove. Therefore, the efficiency of the assembling operation can be enhanced.

In the lamp socket, the opposed retaining projections are formed at the end of the opening of the wire insertion groove, and the distance between the opposed retaining projections is smaller than the outer diameter of the wire.

Therefore, the wire, mounted in the wire insertion groove, is retained by the retaining projections, and is prevented from withdrawal. Therefore, there can be obtained the lamp socket of high reliability.

In the socket assembly of the present invention, the wire connection portion for electrical connection to the terminal members within the connector housing is formed integrally with the lamp socket, and there are used the plurality of lamp sockets which are connected together by the wires connected respectively to the wire insertion grooves in the lamp sockets.

Therefore, the plurality of lamp sockets are beforehand connected together by the wires to form the socket assembly, and by doing so, this assembly can be used for various kinds of lamp unit bodies having different lamp arrangements, and the wire installing operation does not need to be effected at the lamp unit body, and therefore the production cost can be reduced, and a wrong attachment can be eliminated.

In the above socket assembly, the lamp sockets are connected to one another by the wires of different lengths.

Therefore, a wrong attachment can be positively prevented by the different wire lengths.

What is claimed is:

1. A lamp socket mounted on a lamp unit body and connected to another lamp socket through wires, the combination comprising:

a lamp;

the wires;

a connector;

and the lamp socket, including a socket body;

a connector housing for accommodating the connector provided to the socket body;

a bulb mounting portion for mounting the lamp to the socket body; and a monolithic terminal member within the socket body; wherein the terminal member is electrically directly connected to the connector, the lamp, and at least one of the wires, and wherein the terminal member contacts the connector, the lamp, and at least one of the wires, and the terminal member includes a wire connection portion at an end thereof that connects with the at least one of the wires, a connector connection portion at another end thereof that connects with the connector, and a lamp connection portion between the ends thereof that contacts the lamp.

2. The lamp socket according to claim 1, wherein the wire connection portion electrically connects the terminal member to the at least one of the wires.

3. The lamp socket according to claim 2, wherein the wire connection portion comprises a wire insertion groove in which the terminal member is mounted; and the terminal member comprises at one end a press-connecting blade which can bite into a sheath of the at least one of the wires to electrically connect to a conductor of the at least one of the wires, and at another end a male tab projecting into an interior of the connector housing for directly electrically connecting to the connector.

4. The lamp socket according to claim 3, wherein the lamp contacts a portion of the terminal member between the press-connecting blade and the male tab.

5. The lamp socket according to claim 3, wherein the wire insertion groove comprises opposed retaining projections at an end of an opening of the wire insertion groove, and a distance between the opposed retaining projections is smaller than an outer diameter of the at least one of the wires.

6. A socket assembly comprising:

lamps;

wires;

connectors;

a lamp unit body; and a plurality of lamp sockets mounted on the lamp unit body and connected together through the wires, each of the plurality of lamp sockets comprising;

a socket body;

a connector housing for accommodating one of the connection to the socket body;

a bulb mounting portion for mounting one of the lamps to the socket body; and a monolithic terminal member within the socket body; wherein the terminal member is electrically directly connected to the connector, the lamp, and at least one of the wires;

wherein the plurality of lamp sockets are electrically connected together through the wires connected to the terminal members, and wherein the terminal member contacts the connector, and contacts the lamp and at least one of the wires; and the terminal member includes a wire connection portion at an end thereof that connects with the at least one of the wires, a connector connection portion at another end thereof that connects with the connector, and a lamp connection portion between the ends thereof that contacts the lamp.

7. The socket assembly according to claim 6, wherein the plurality of lamp sockets are connected to one another by wires of different lengths.

8. The socket assembly according to claim 6, wherein the wire connection electrically connects the terminal member to the at least one of the wires.

9. The socket assembly according to claim 8, wherein the wire connection portion comprises a wire insertion groove in which the terminal member is mounted; and the terminal member comprises at one end a press-connecting blade which can bite into a sheath of the at least one of the wires to electrically connect to a conductor of the at least one of the wires, and at another end a male tab projecting into an interior of the connector housing for directly electrically connecting to the connector.

10. The socket assembly according to claim 9, wherein the lamp contacts the lamp connection portion of the terminal member between the press-connecting blade and the male tab.

11. The socket assembly according to claim 9, wherein the wire insertion groove comprises opposed retaining projections at an end of an opening of the wire insertion groove, and a distance between the opposed retaining projections is smaller than an outer diameter of the at least one of the wires.

12. A socket assembly comprising:

lamps;

wires;

connectors;

a lamp unit body; and a plurality of lamp sockets mounted on the lamp unit body and electrically connected together through wires, each of the plurality of lamp sockets comprising:

a socket body including a wire connection portion;

a connector housing for accommodating one of the connectors to the socket body, a bulb mounting portion for mounting one of the lamps to the socket body; and a monolithic terminal member provided within the socket body; wherein the terminal member is electrically directly connected to the connector, the lamp, and at least one of the wires;

wherein the terminal member includes two ends, one end including a press-connecting wire connection portion provided within the wire connection portion of the socket body, the press-connecting portion contacting the terminal member to a conductor of at least one of the wires, wherein another end of the two ends has a connector portion that projects into the connector housing and contacts the connector, and wherein a portion of the terminal member between the press-connecting portion and the connector portion contacts the one of the lamps.

13. The socket assembly according to claim 12, wherein the wire connection portion comprises a wire insertion groove in which the terminal member is mounted.

14. The lamp socket according to claim 13, wherein the wire insertion groove includes opposed retaining projections at an end of an opening of the wire insertion groove, and a distance between the opposed retaining projections is smaller than an outer diameter of the at least one of the wires.

15. The socket assembly according to claim 12, wherein the one end includes a press-connecting blade which can bite into a sheath of the at least one of the wires to electrically connect the terminal member to the conductor of the at least one of the wires, and the other end includes a male tab projecting into an interior of the connector housing for directly electrically connecting to the connector.

16. The socket assembly according to claim 13, wherein the one end includes a press-connecting blade which can bite into a sheath of the at least one of the wires to electrically connect the terminal member to the conductor of the at least one of the wires, and the other end includes a male tab projecting into an interior of the connector housing for directly electrically connecting to the connector.

17. The socket assembly according to claim 12, wherein the terminal member is a monolithic structure.

18. The socket assembly according to claim 17, wherein the wire connection portion comprises a wire insertion groove in which the terminal member is mounted.

19. The lamp socket according to claim 18, wherein the wire insertion groove include opposed retaining projections at an end of an opening of the wire insertion groove, and a distance between the opposed retaining projections is smaller than an outer diameter of the at least one of the wires.

20. The socket assembly according to claim 17, wherein the one end includes a press-connecting blade which can bite into a sheath of the at least one of the wires to electrically connect the terminal member to the conductor of the at least one of the wire, and the other end includes a male tab projecting into an interior of the connector housing for directly electrically connecting to the connector.

* * * * *